United States Patent [19]

Tanabe et al.

[11] Patent Number: 4,918,298

[45] Date of Patent: Apr. 17, 1990

[54] CHECKIN GATE APPARATUS

[75] Inventors: Haruo Tanabe, Kyoto; Masaji Ishida, Takatsuki; Tomoya Fujino, Ootsu; Tadahiko Kurata, Nagaokakyo, all of Japan

[73] Assignee: Omron Tateisi Electronics Co., Kyoto, Japan

[21] Appl. No.: 126,614

[22] Filed: Nov. 30, 1987

[30] Foreign Application Priority Data

Dec. 1, 1986 [JP] Japan ..... 61-287087
Jul. 8, 1987 [JP] Japan ..... 62-170478

[51] Int. Cl.[4] ..... G07B 15/02
[52] U.S. Cl. ..... 235/384; 235/382
[58] Field of Search ..... 235/384, 382; 83/107

[56] References Cited

U.S. PATENT DOCUMENTS 3,580,121 5/1971 Asada ..... 83/107
4,086,475 4/1978 Churchill ..... 235/382
4,288,688 9/1981 Kiyama ..... 235/384

FOREIGN PATENT DOCUMENTS 1911504 9/1969 Fed. Rep. of Germany .
1574090 7/1971 Fed. Rep. of Germany .
2114346 8/1983 United Kingdom .

OTHER PUBLICATIONS

European Search Report, Vienna, 01-16-89.

*Primary Examiner*—Harold I. Pitts
*Attorney, Agent, or Firm*—Stevens, Davis, Miller & Mosher

[57] ABSTRACT

A checkin gate apparatus comprises a carry-in path for carrying in a ticket inserted into an insertion slot; a reader section disposed in the course of the carry-in path to read information recorded on the inserted ticket; a ticket cutter device for cutting off the ticket into two half stubs after the reader section has read recorded information; a switchable carry path for distributing the two cut-off ticket stubs into a collection direction and a discharge direction; a collection path for collecting one of the two stubs of the ticket; and a carry-out path for carrying out the other of the two stubs of the ticket to a discharge slot. In particular, all the above-mentioned sections are housed within a movable or portable casing provided with casters and/or a handle.

11 Claims, 10 Drawing Sheets

CHECKIN GATE APPARATUS

BACKGROUND OF THE INVENTION

1. Field of the Invention

The present invention relates to a checkin gate apparatus and more specifically to an apparatus for reading various information recorded on air tickets or boarding cards in an airport to totalize data related to passengers.

2. Description of the Prior Art

The conventional checkin gate apparatus are all fixedly installed at a boarding gate. Therefore, there exists a problem in that some installation work is required and further the installation position is somewhat limited. Further, in case the apparatus develops trouble, it is impossible to replace the disabled apparatus with another normal apparatus, thus resulting in complicated checkin processing.

SUMMARY OF THE INVENTION

The object of the present invention is to provide a novel checkin gate apparatus such that no installation work is required; installation position is not limited; and when the apparatus develops trouble, it is possible to easily replace it with another one for continuously performing the checkin processing.

To achieve the above-mentioned object, a checkin gate apparatus of the present invention comprises: carrying-in means for carrying in a ticket inserted into an insertion slot; reading means disposed in the course of a carry path of said carrying-in means, for reading information recorded on an inserted ticket; ticket cutting means for cutting off the ticket into two half ticket stubs after said reading means has read recorded information; distributing means for distributing the two cut-off ticket stubs into a collection direction and a discharge direction; collecting means for collecting one of the cut-off stub of the ticket; and carrying-out means for carrying-out the other of the cut-off stub of the ticket to a discharge slot to discharge it.

According to the present invention, when passengers or clerks simply insert tickets (air tickets or boarding cards) into the insertion slot of the apparatus, information recorded on the ticket can be read to check and totalize any desired matters related to the passengers. Each ticket is cut off into two half stubs, and one stub is collected and the other stub is discharged through the discharge slot. Therefore, a stub discharged from the discharge slot can be handed over to a passenger or the passenger can take a discharged stub for himself and carry a stub already checked.

The above-mentioned carrying-in means, reading means, ticket cutting means, distributing means, collecting means, and carrying-out means are all housed within a casing which is movable or conveyable, thus realizing a movable checkin gate apparatus. The above casing is of wagon-type casing provided with casters (small wheels) or the casing is provided with a handle instead of or in addition to the casters.

The movable checkin gate apparatus according to the present invention can be simply moved to any required position, without special installation work or without being limited to a special installation position, thus permitting checkin processing at any place required. In addition, in case the apparatus develops trouble, since the disabled apparatus can easily be replaced with a normal movable checkin gate apparatus, it is possible to start or continue the checkin processing without long interruption.

BRIEF DESCRIPTION OF THE DRAWINGS

FIG. 7 is a plan view thereof; FIG. 8 is a bottom view of a frame; and FIG. 9 is a side view thereof;

DETAILED DESCRIPTION OF THE PREFERRED EMBODIMENTS

The present invention will be described in detail hereinbelow with respect to its application to an apparatus arranged at a boarding gate in an airport to check boarding cards of passengers who have already completed their checkin procedure.

Figure 1:
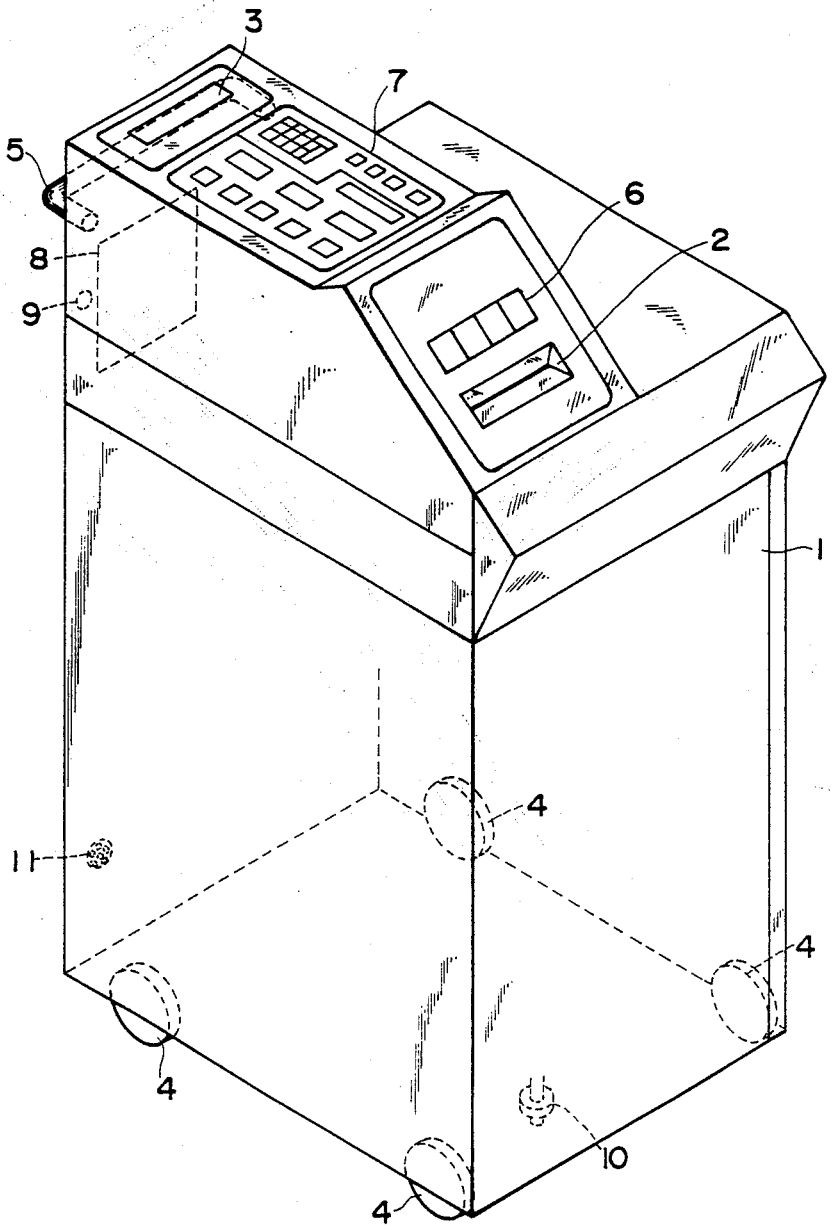
FIG. 1 is a perspective outside view of a wagon-type checkin gate apparatus of the present invention.

FIG. 1 shows an outside view of a wagon-type checkin gate apparatus. The major mechanism of the checkin gate apparatus is housed in the upper portion of a casing 1. Four casters 4 are rotatably attached under the casing 1. This checkin gate apparatus can be moved to any required position by griping a handle 5 provided on the upper portion of the casing 1 and in dependence upon the rotary motion of the casters 4. This casing 1 can be fixed by protruding a rod brake 10 downward to prop the casing 1 on the floor.

A boarding card insertion slot 2 and a guidance display section 6 are provided on the front surface of the upper portion of the casing 1. This slot 2 is also used as a return slot where an improper or an inappropriate ticket or card is returned to a passenger. On the display section 6, a flight number and a gate number (where necessary) are displayed. Data related to a flight number are entered via a clerk operation section 7 provided on the upper surface of the casing 1. A ticket discharge slot 3 is formed on the upper surface of the rear part of the casing 1. While a proper boarding card inserted into the insertioon slot 2 is being carried within the apparatus, information recorded on the card is read and thereafter the card is cut off into two half stubs. Since one of the cut-off stub is discharged from the discharge slot 3, this discharged stub is took up by the passenger or by a clerk to hand it over to the passenger. The other of the cut-off stub is collected into a collection cassette (12 in FIG. 4) disposed within the apparatus. Further, a lid 8 is provided on the upper rear surface of the casing 1 to take out the collection cassette. This lid 8 is usually locked by a lock device 9 for safety.

This checkin gate apparatus is operative in both on-line mode and off-line mode. In the case of on-line mode operation, this apparatus is coupled to a host computer via transmission lines. A connector 11 is provided for the apparatus for connection with a host computer. This connector 11 is coupled via a cable to another connector disposed at an appropriate position (e.g. in a wall or post near a boarding gate) in an airport building. Since this cable can be removed freely, the apparatus can be moved freely.

Figure 2:
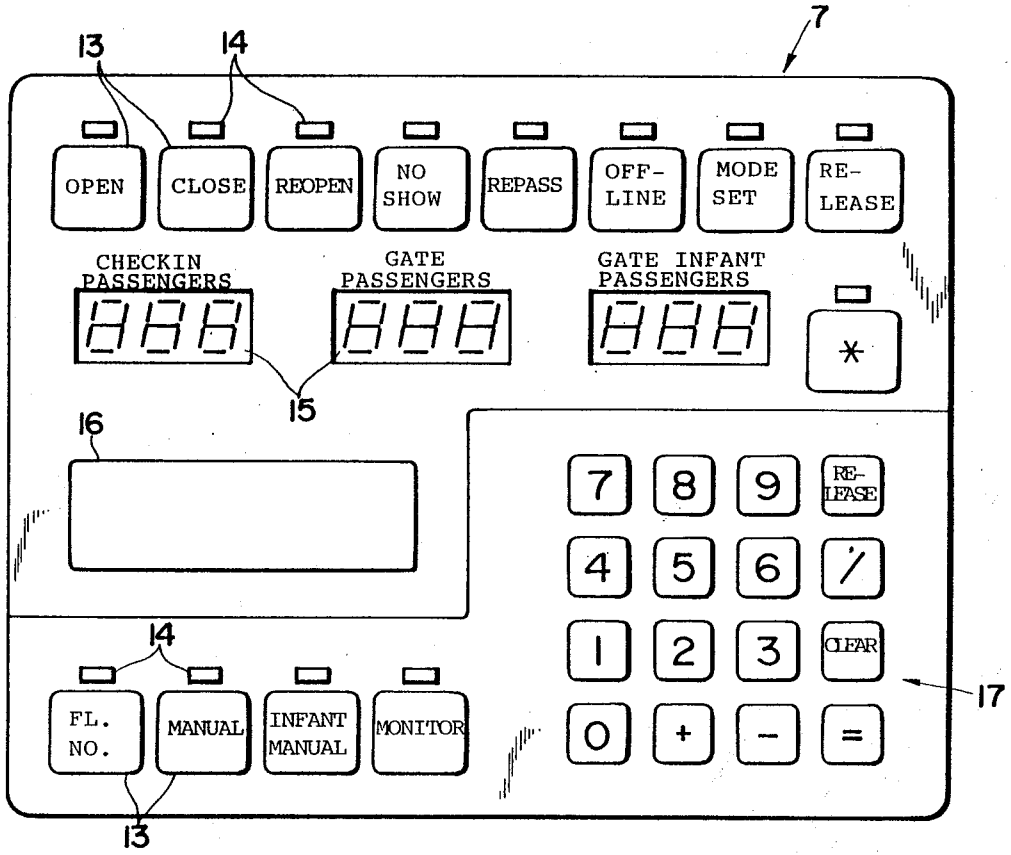
FIG. 2 is a plan view showing an arrangement of a clerk operation section.

FIG. 2 shows the clerk operation section 7 in which various operation keys and display units are arranged. In more detail, in this clerk operation section 7, there are arranged various function keys 13; indicators (lamps) 14 lit up when each corresponding function key 13 is depressed; numerical display units 15 for indicating the number of checked-in passengers (checkin passengers), the number of passengers who passed through the gate (gate passengers), and the number of infant passengers who passed through the gate (gate infant passengers); a LCD (liquid crystal display) clerk display 16; and ten-key pad 17.

The functions of some typical function keys 13 will be described below: An OPEN key is depressed when boarding gate work is started in on-line mode. A CLOSE key is depressed when the boarding gate work is ended. A REOPEN key is depressed to restart the gate boarding work for a flight number which has once been ended. A NO-SHOW key is depressed to display a name or passenger information of a passenger who has already completed checkin procedure but not yet passed through the boarding gate on the clerk display 16. An OFF-LINE key is depressed to start boarding gate work in an off-line mode. A FLIGHT NUMBER (FL. NO.) key is used to enter a flight number data via the ten-key pad 17. A MONITOR key is used to display the number of passengers who have passed through gate for each zone.

The LCD clerk display 16 can indicate characters such as numerals, letters, etc. On this clerk display 16, various information is displayed such as the number of passengers passed through gate for each zone, a list of passengers of NO-SHOW (checked-in but not yet passed through gate), alarm messages (get off an airplane, give messages, seat release passengers, etc.), error messages (improper boarding card, that is, errors in date, flight No. format, etc.), trouble messages (jamming, abnormal transmission, etc.), key input messages, etc.

Figure 3:
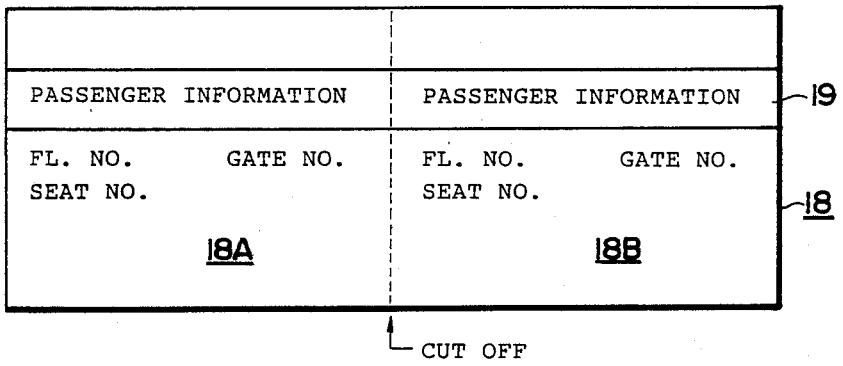
FIG. 3 is an example of a boarding card.

FIG. 3 shows an example of a boarding card (or an air ticket) used for this checkin gate apparatus. In this boarding card 18, passenger information is recorded magnetically. For this purpose, a magnetic stripe 19 is formed on the card or ticket 18 along the longitudinal direction thereof. As described later in more detail, the boarding card 18 is cut off into two at roughly the middle thereof within the checkin gate apparatus. The same passenger information is magnetically recorded on each half stub 18A or 18B in order that passenger information can be read magnetically from each stub 18A or 18B; that is, so that passenger information on the magnetic stripe 19 will not be destroyed when the card is cut off into two. The passenger information is flight route, flight number, date of flight, passenger class, seat number, ticket number, date of issue, name, age, sex distinction, address or telephone number, fare, payment method, transfer flight information, etc. Further, on the boarding card 18, a flight number, gate number, seat number, etc. are recorded visibly by printing these data, for instance. The passenger information may be recorded so as to be readable photomagnetically or optically, in stead of magnetical recording method.

Figure 4:
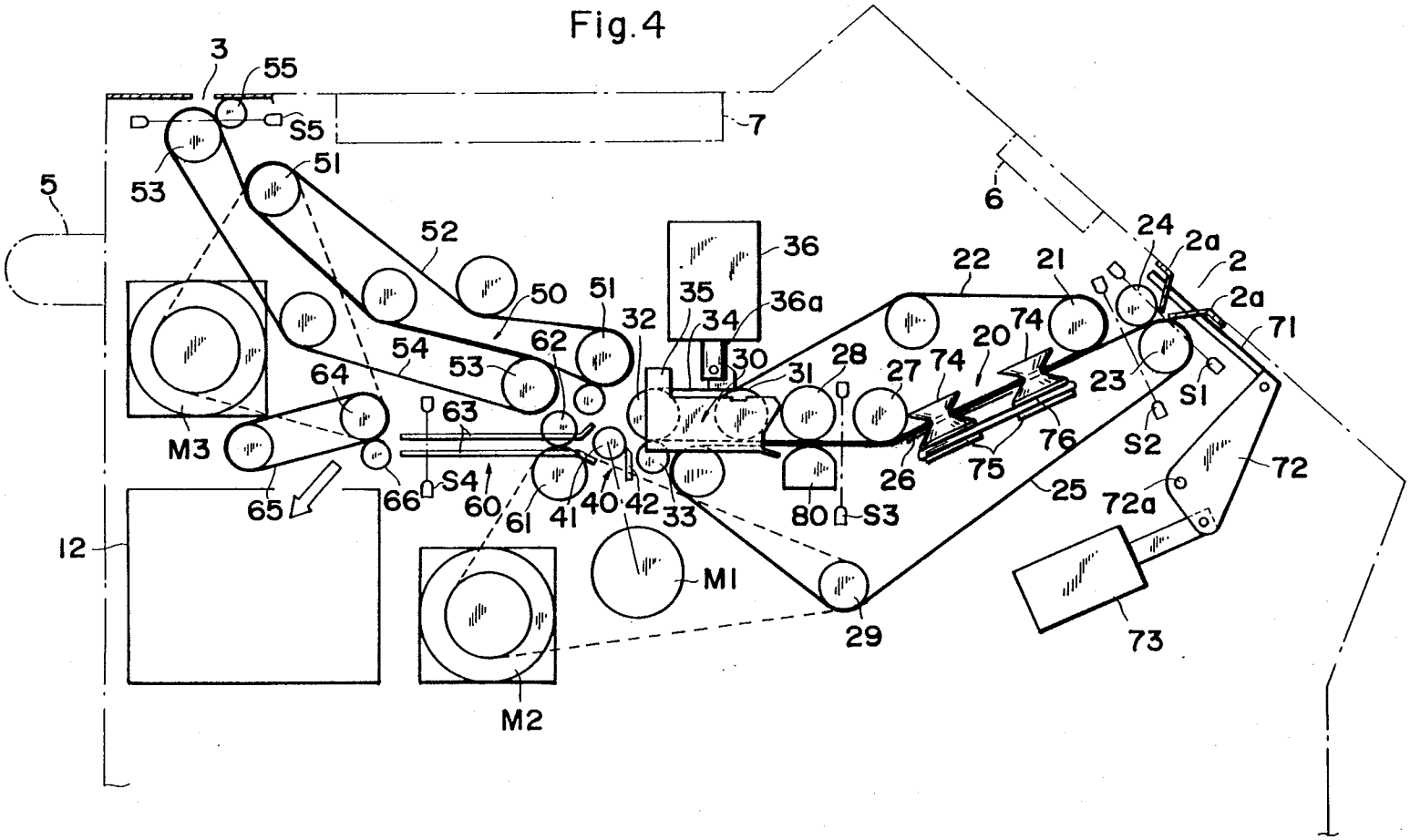
FIG. 4 is a diagrammatical illustration showing the mechanism of the checkin gate apparatus.

FIG. 4 shows an essential portion of the mechanism arranged on the upper portion of the casing 1.

A carry-in path 20 is provided from the insertion slot 2 to the inside. At an end of this carry-in path 20, a switchable carry path 30 is provided. On the way of this carry path 20, a magnetic head 80 is arranged to read passenger information recorded on the stripe 19 of each boarding card 18. A cutter device 40 is provided at an end of the switchable carry path 30 to cut off the boarding card 18 into two half stubs. From this position of the cutter device 40, a carry-out path 50 and a collection path 60 start. The carry-out path 50 extends to the discharge slot 3 and the collection path 60 extends to a collection cassette 12. One of the half stub 18A of the cut-off card is collected in the collection cassette 12 via a collection path 60, and the other of the half stub 18B is fed from the switchable carry path 30, through the carry path 50, to the discharge slot 3.

Various sensors S1, S2, S3, S4 and S5 are arranged near the insertion slot 2, along the carry-in path 20 (at a position a little inward away from the insertion slot 2), near the magnetic head 80, on the way of the collection path 60, and near the discharge slot 3 in order to detect the passing of cards. These sensors S1 to S5 are photoelectric sensors, for instance.

As described later, each carry path is composed of rollers and belts reeved around these rollers. In FIG. 4, belts constituting the carry path are shown by solid lines. The carry-in path 20, the switchable carry path 30 and a part of the collection path 60 are driven by a drive motor M2. The carry-out path 50 and a part of the collection path 60 are driven by a drive motor M3. Belts for transmitting power from these drive motors M2 and M3 to these carry paths are shown by dashed lines in FIG. 4.

Figure 6:
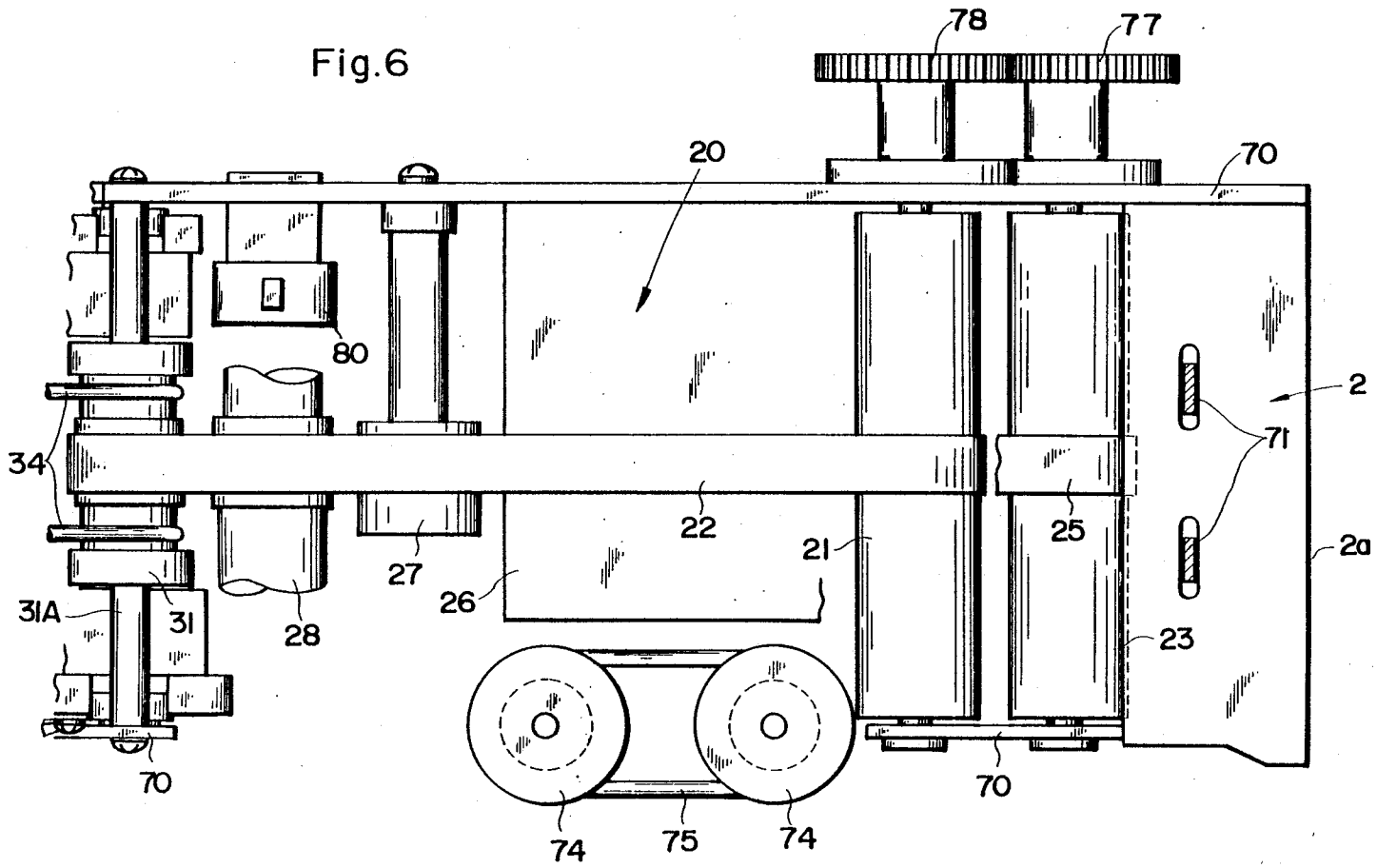
FIG. 6 is an enlarged plan view showing a carrying-in path of the mechanism shown in FIG. 4.

FIG. 6 is an enlarged plan view showing the carry-in path 20. With reference to FIGS. 4 and 6, the insertion slot 2 is composed of two guide plates 2*a* disposed in such a way that the interval between the two decreases as they extend in the inward direction. A shutter 71 is provided passing through holes formed in the guide plates 2*a*. This shutter 71 is opened or closed via a link plate 72 pivotably driven about an axle 72*a* by a solenoid 73.

A number of rollers 21, 27, 28, 31 and so on are rotatably disposed between two right and left frames 70. A carry belt 22 is reeved around the above rollers at their center. In the same way, a carry belt 25 is reeved around rotatable rollers 23, 29 and so on. The portion at which two belts 22 and 25 are overlapped is the carry path 20. A guide plate 26 is disposed at an appropriate position of the carry path 20. Two spur gears 77 and 78 in mesh with each other are attached to axles of the rollers 21 and 23, respectively. When the roller 29 is driven by the motor M2 via the belt shown by dashed lines, since power is transmitted from the roller 23 to the roller 21 via the spur gears 77 and 78, all the rollers and belts 21 and 25 are driven. A roller 24 disposed near the slot 2 is also rotated in contact with the roller 23.

Two regulation rollers 74 are arranged on one side of the carry path 20. The regulation roller 74 has an axle perpendicular to the surface of the carry path 20. The diameter of the roller 74 is the minimum at the central portion of the width. These rollers 74 rotate simultaneously by a belt 76 reeved around a pulley 75 coaxial with the roller 74. Although not shown, the rollers 74 are also driven by the motor M2.

A magnetic head 80 is disposed on the opposite side remote from the regulation roller 74. The position of the boarding card 18 inserted into the insertion slot 2 is regulated by the rollers 74 so as to be in parallel to the carrying direction when being fed along the carry-in path 20. By doing this, the magnetic head 80 can correctly read data recorded on the magnetic stripe 19 of the card 18. Further, when magnetic heads are disposed at two or four different positions, passenger information can be read from the card even if the card is inserted face down or front back.

Figure 5:
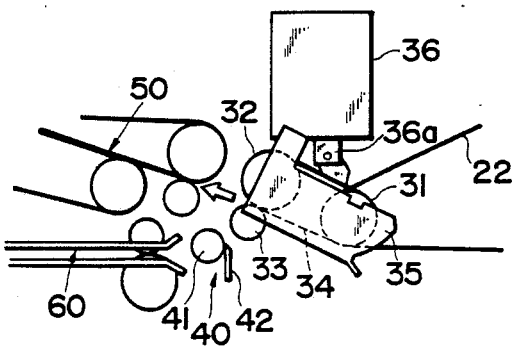
FIG. 5 is an illustration showing a part of the mechanism, in which a switchable carrying path is driven into a switched position.
Figure 7:
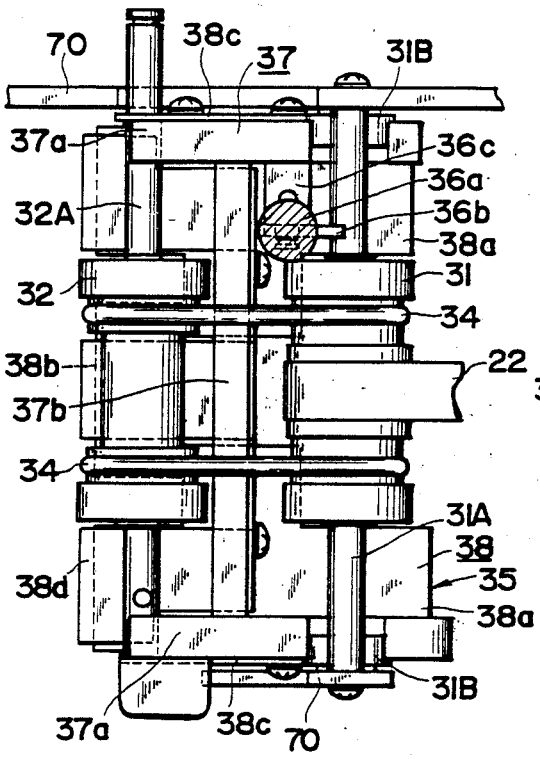
FIGS. 7 to 9 are enlarged views of the switchable carry path.
Figure 9:
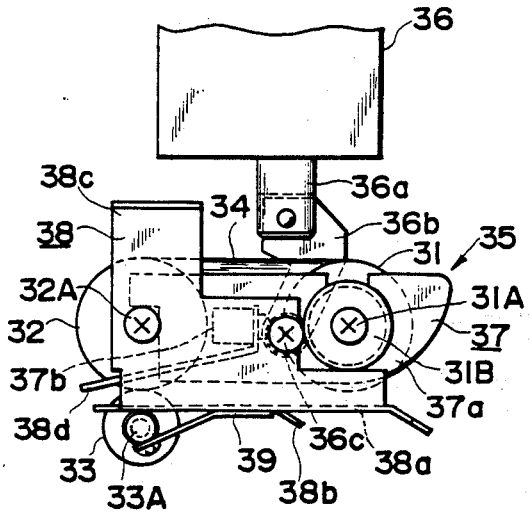

FIGS. 7 and 9 show the details of the switchable carry path 30, and FIG. 5 shows the status where the path 30 is actuated. With reference to these drawings including FIG. 4, the switchable path 30 is made up of a frame 35, rollers 31 and 32 rotatably supported by this frame 35, belts 34 reeved around these rollers 31 and 32, and rollers 33 rotatably disposed on the frame 35 roughly in contact with the roller 32. The frame 35 is rotatably supported by an axle of the roller 31. A plunger 36*a* of a solenoid 36 is linked to the frame 35 via a link. The frame 35 is ordinarily supported by the solenoid 36 in such a way that the carry-in path 20 is connected to the collection path 60 as shown in FIG. 4. However, when a cut-off stub 18B is fed to the carry-out path 50, as shown in FIG. 5, the solenoid 36 is driven to pivot the frame 35 about the axle of the roller 31, so that the path end is disposed near a start end of the carry-out path 50.

Figure 8:
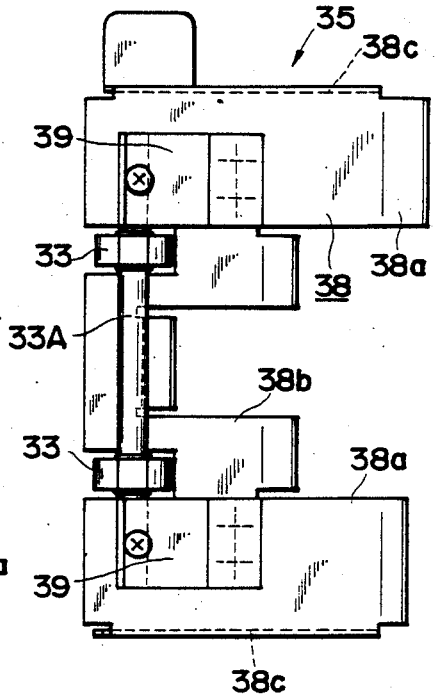

With reference to FIGS. 7 to 9, the frame 35 is composed of a roughly H-shaped member 37 (FIG. 7) when seen from above, and a plate assembly 38 which covers both the side surfaces and the bottom surface of this member 37. The member 37 includes both side portions 37*a* and a middle portion 37*b* connecting these side portions 37*a*. As best shown in FIG. 8, the plate assembly 38 is made up of two bottom both-side guide portions 38*a*, middle guide portion 38*b* connecting the portions 38*a*, and two vertical portions 38*c* vertically extending from both sides of the guide portions 38*a*. When the two rise portions 38*c* are fixed by screws to the side portions 37*a* of the member 37, the member 37 and the plate assembly 38 are fixed to each other.

An axle 31A of the roller 31 is fixed to two side frames 70. The roller 31 is rotatably supported by this axle 31A. The frame 35 is also rotatably supported by the axle 31A via bearings 31B at the portions 37*a*. A belt 22 serving as the carry-in path 20 is reeved around the center of the roller 31.

An axle 32A of the roller 32 is fixed between the two vertical portions 38*c* of the frame 35, and the roller 32 is rotatably supported by the axle 32A. Two belts 34 are reeved around two rollers 31 and 32.

Two fixture pieces 39 are fixed to the guide portions 38*a*, respectively on the lower surface of the frame 35; and an axle 33A is fixed between these fixture pieces 39 by screws. A roller 33 roughly in contact with the roller 32 is rotatably supported by the axle 33A. Further, an upper guide plate 38*d* is fixed to the portion 37*b* by screws. A boarding card 18 fed from the carry-in path 20 is passed through a gap between the roller 31 and the plate guide portions 38*a*, and then passed between the two rollers 32 and 33.

An arm 36*c* is fixed to one of the side portions 37*a* of the member 37, and a link 36*b* is linked by a pin between this arm 36*c* and an end of the plunger 36*a* of the solenoid 36.

Figure 10:
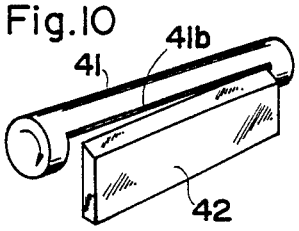
FIG. 10 is a perspective view showing a cutter device.
Figure 11A:
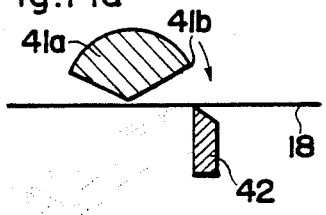
FIGS. 11*a*, 11*b* and 11*c* are cross-sectional views of the cutter device for assistance in explaining the operation thereof.
Figure 11B:
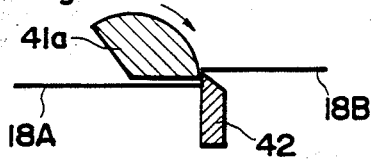
Figure 11C:
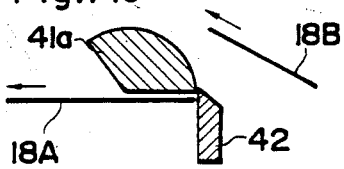

Returning to FIG. 4 again, the cutter device 40 includes a rotary blade 41 and a fixed blade 42. FIG. 10 shows the structure of the cutter device 40 and FIGS. 11*a*, 11*b* and 11*c* show the sequential operations of the device 40. As shown in FIGS. 11*a* to 11*c*, the rotary blade 41 is formed into a fan-shape in cross section at the middle portion 41*a* thereof except both the ends thereof. An edge 41*b* (cutting blade) of the middle portion 41*a* is a little inclined with respect to the fixed blade 42 so as to provide a cutting angle. When the rotary blade 41 rotates, the edge 41*b* is brought into contact with the fixed blade 42 from one end thereof to the other end thereof continuously to cut off a card or ticket.

When the central portion of a boarding card 18 fed through the switchable carry path 30 which is positioned as shown in FIG. 4 comes to a position of the fixed blade 42, the card 18 is stopped from being fed (FIG. 11*a*). The rotary blade 41 is rotated by a drive motor M1 to cut off the card 18 into two half stubs 18A and 18B (FIG. 11*b*). Thereafter, a front stub 18A is immediately fed toward the collection cassette 12 via the collection path 60, and simultaneously the solenoid 36 is driven to incline the switchable carry path 30 as shown in FIG. 5, so that the back stub 18B is fed to the carry-out path 50 (FIG. 11*c*).

Figure 11D:
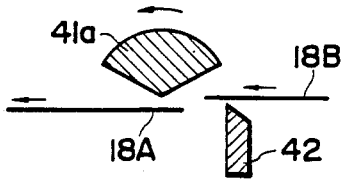
FIG. 11*d* is a similar view, which shows a state where a rear half stub of a cut-off ticket is fed through the cutter device when no switchable carry path is present.

If the switchable carry path 30 is absent and further a switching device between the collection path 60 and the carry-out path 50 is provided on the forward side of the cutter device 40 in the card feed direction, not only the stub 18A but also stub 18B should be fed passing through the cutter device 40. In this case, as shown in FIG. 11*d*, the rear half stub 18B cannot be fed until the rotary blade 41 has been returned to the original position. In other words, the rear stub 18B can be started to feed only after the rotary blade 41 has returned to the original position. Therefore, the feed motion of the stub 18B is delayed by a time required for the return operation of the rotary blade 41, so that the time when the stub 18B appears at the discharge slot 3 is delayed. This means that the operation speed of the checkin gate apparatus is slow. In contrast with this, in the present invention, as shown in FIG. 11*c*, since the stub 18B can be sent to the carry-out path 50 without waiting the return operation of the rotary blade 41, it is possible to increase the operation speed of the entire processing of the apparatus.

Returning to FIG. 4 again, the carry-out path 50 is made up of some rollers 51, belts 52 reeved around the rollers 51, some other rollers 53 and other belts 54 reeved around the rollers 53, and a roller 55 in contact with the roller 53 disposed near the discharge slot 3, being driven by the motor M3.

The collection path 60 is made up of a roller 61 driven by the motor M2, a roller 62 in contact with this roller 61, upper and lower guide plates 63, rollers 64 one of which is driven by the motor M3, belts 65 reeved around these rollers 64, and a roller 66 in contact with the roller 64.

Figure 12:
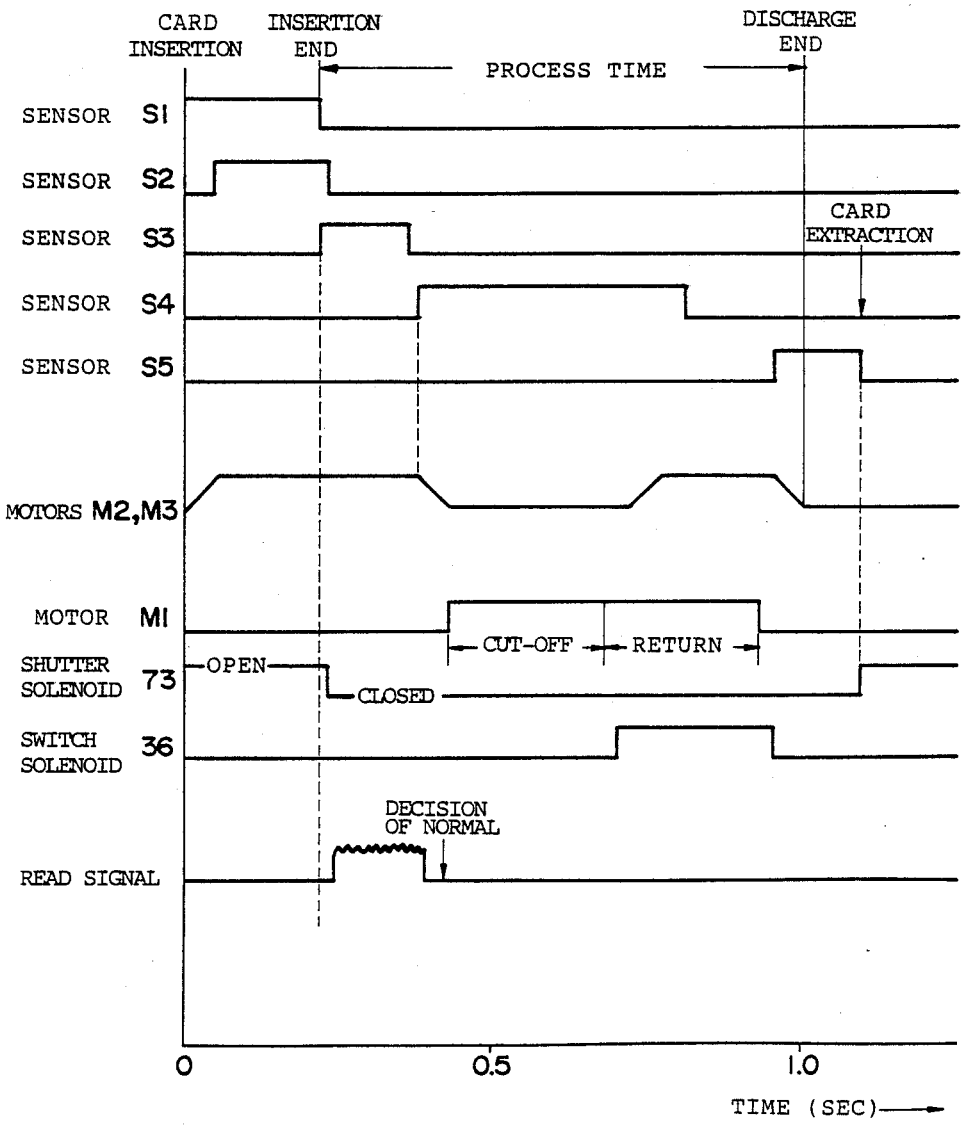
FIG. 12 is a timing chart showing the entire operation of the checkin gate apparatus.

With reference to a timing chart shown in FIG. 12, the operation of the entire apparatus will be explained hereinbelow.

When a boarding card 18 is inserted through the insertion slot 2, the motors M2 and M3 are driven in the forward direction on the basis of a card insertion detection signal from the sensor S1, so that the inserted boarding card 18 is fed through the carry-in path 20. When the sensor S3 detects a front end of the boarding card 18, the magnetic head 80 starts to read data recorded on the card. Further, the shutter 71 closes the insertion slot 2 to inhibit the next boarding card from being inserted. The stripe data read by the magnetic head 80 are checked (checking is described later). If the stripe data are normal, the card 18 is fed to the cutter device 40. If the stripe data are improper or inappropriate, the motors M2 and M3 are driven in the reverse direction to return it to the insertion slot 2, and an error message is displayed in the clerk display section 16.

When the sensor S4 detects the front end of the proper boarding card, the motors M2 and M3 are stopped and a cutter motor M1 is rotated to cut off the boarding card into two front and rear half stubs. Thereafter, the solenoid 36 is driven, and the switchable carry path 30 which holds the rear stub 18B is inclined to a status as shown in FIG. 5 and the motors M2 and M3 are driven in the forward direction. By this, the front stub 18A is collected into the collection cassette 12 via the collection path 60, while the rear stub 18B is fed to the discharge slot 3 via the carry-out path 50. When the sensor S5 detects that the stub 18B is extracted from the discharge slot 3, the solenoid 73 opens the shutter 71 to allow the next boarding card to be inserted.

As described above, since the collection operation of the stub 18A and the carry-out operation of the stub 18B can be effected simultaneously, it is possible to reduce the gate processing time, thus realizing a high speed checkin gate apparatus.

Figure 13:
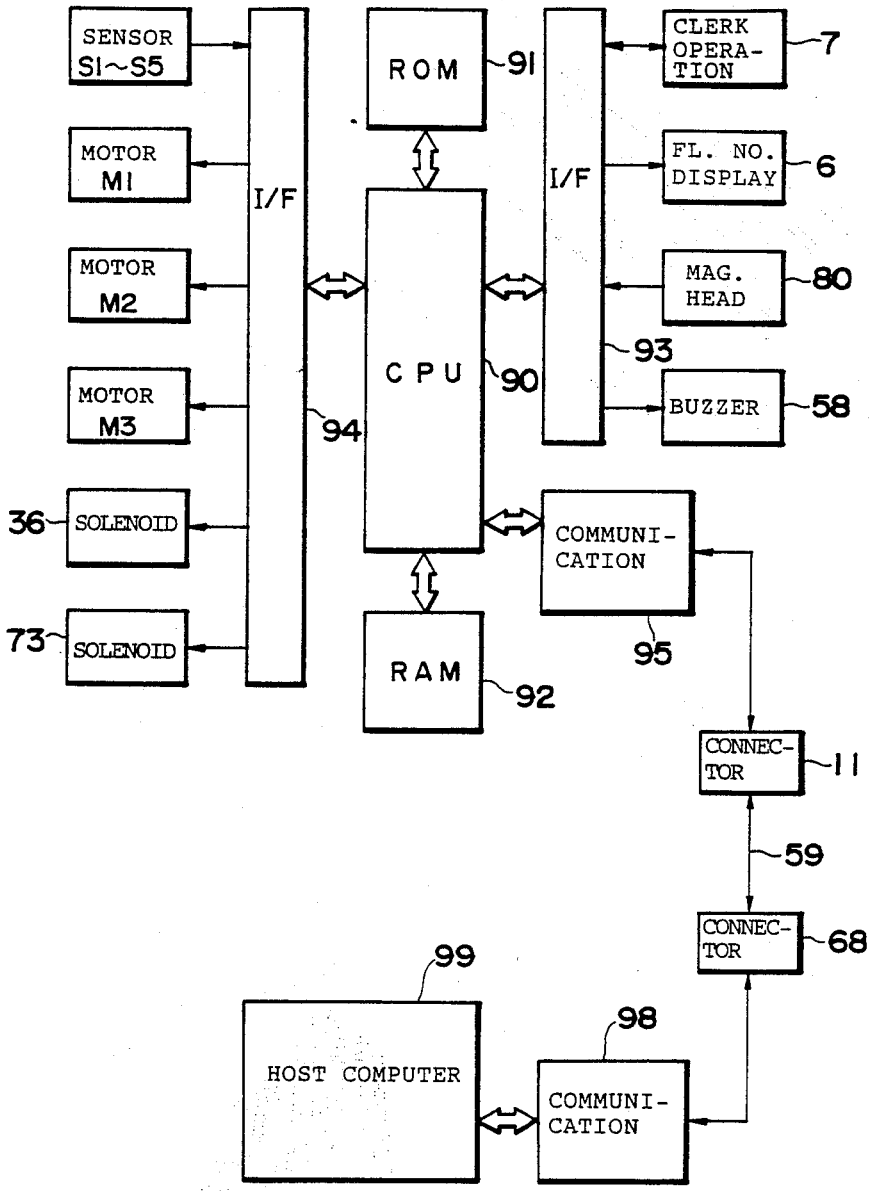
FIG. 13 is an electric block diagram of the checkin gate apparatus.

FIG. 13 is an electric block diagram of the checkin gate apparatus of the present invention. The entire operation of this apparatus can be controlled by a CPU 90 having a ROM 91 for storing operation programs and a RAM 92 for storing various data for totalization processing. To the CPU 90, the clerk operation section 7, flight number display 6, magnetic head 80, and an electronic buzzer 58 (for informing the clerk that a passenger who is necessary to be guided by a clerk or who changes his seat number has passed through the gate apparatus) are connected via an interface 93; and sensors S1 to S5, motors M1 to M3 and solenoids 36 and 73 are connected via an interface 94. The operation described with reference to FIG. 12 is implemented under the control of the CPU 90. The controller shown in FIG. 13 are installed within the casing 1. Further, this apparatus is provided with a communications apparatus 95 including modem to communicate with a host computer 99. The communications apparatus 95 is connected to the afore-mentioned connector 11.

The host computer 99 is also provided with a communications apparatus 98 connected to a connector 68 provided in a wall or a post of an airport building as already explained. By connecting the connector 11 of the checkin gate apparatus with the connector 68 of the wall or post via a cable 59, the CPU 90 of the checkin gate apparatus is connected to the host computer 99 in on-line mode.

When the checkin gate apparatus is operated in off-line mode, a clerk (operator) depresses the OFF-LINE key in the clerk operation section 7 and enters a flight number by using the FLIGHT NUMBER key and the ten-key pad 17. The entered flight number is displayed in the display unit 6. If necessary, the clerk inputs date.

When an inserted boarding card is read by the magnetic head 80, the format of the read data, the flight number and the date are checked. If determined to be unacceptable in these data check operation, the boarding card is returned to the insertion slot 2 and this is indicated on the display section 16. Further, the CPU 90 checks double seat allocations, this is because when two passengers' seat number is the same, the seat should be changed. This double seat allocation trouble can be indicated on the display section 16. Furthermore, special passengers can be checked.

The CPU 90 further implements totalization processing such as counting of the number of inserted boarding cards, counting of the number of boarding cards for each zone, etc. on the basis of the data on boarding cards. The counted results are stored in the RAM 92 and also displayed on the display section 15. All the data related to passengers passed through the gate apparatus such as seat numbers, passenger numbers, classes, kinds (aged persons, children, infants) and data related zones are all stored in the RAM 92.

In the case of on-line mode operation, the clerk depresses the OPEN key and enters a flight number. The entered flight number data is transmitted to the host computer. In response to this flight number data, the host computer transmits a flight number, date, seat change information, etc. to the checkin gate apparatus.

In the case of on-line mode operation, checking, totalization, storing processing of the data related to inserted boarding cards are implemented as in off-line mode. The gate apparatus transmits totalized results to the host computer where necessary.

Further, the clerk can display necessary information such as NO-SHOW passengers (checked-in but not yet passed through the boarding gate) on the display section 16 by use of the function keys 13, where necessary.

Figure 14:
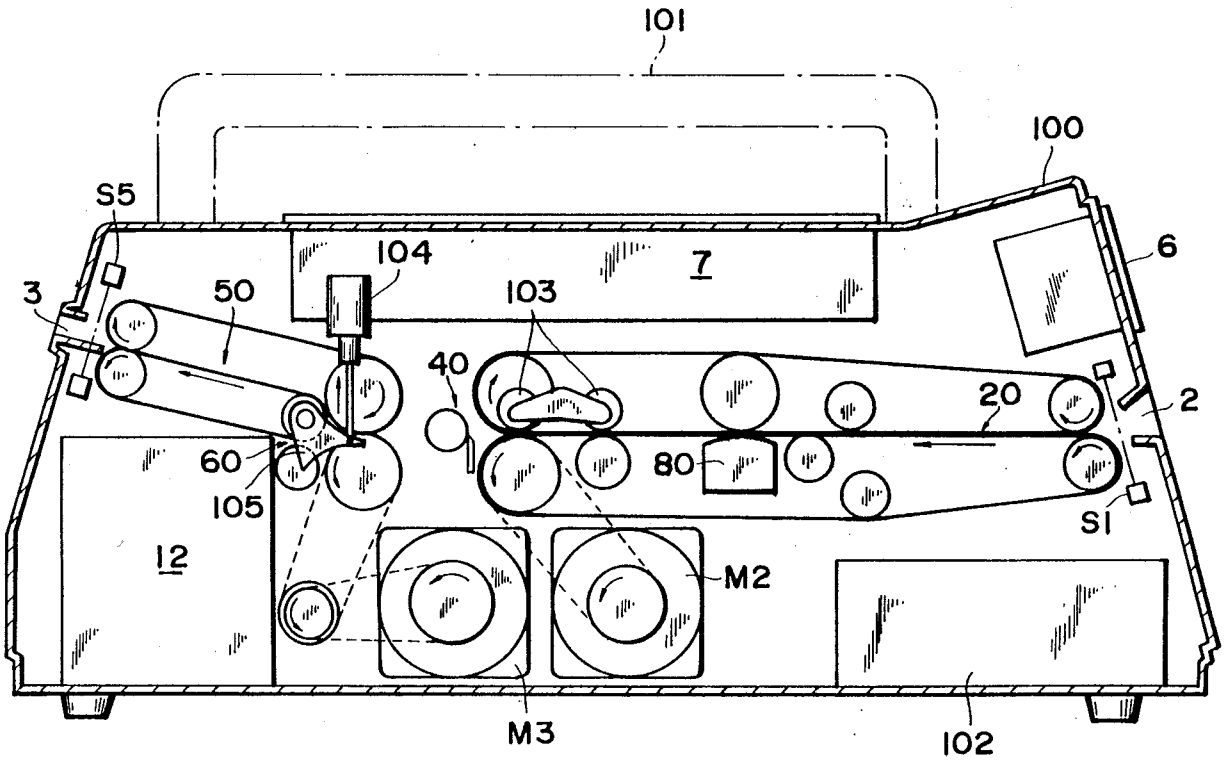
FIG. 14 is an illustration showing a construction of a desk-top checkin gate apparatus of the present invention.

FIG. 14 shows a desk-top portable checkin gate apparatus. The same elements or sections having the same functions as those shown in FIG. 4 are designated by the same reference numerals, and the description thereof being omitted herein.

A casing 100 is provided with a handle 101, so that this gate apparatus can be moved by using this handle 101. A switchable flapper 105 is provided at a branch position of the carry-out path 50 and the collection path 60 and driven by a solenoid 104 so as to be switched. A touch roller 103 is provided at an end portion of the carry-in path 20 to hold a rear half stub. A controller unit 102 as shown in FIG. 13 is housed in the casing 100. The carry-in path 20 is driven by a motor M2, and the carry-out path 50 and the collection path 60 are driven by the motor M3, separately. The motor M1 for the cutter device 40, the sensors S2 to S4, the shutter 71 and the solenoid 73, etc. are not shown.

In this apparatus, after data have been read by the magnetic head 80, the boarding card is fed to the cutter device 40 and then cut off after the motors M2 and M3 have been stopped. The switchable flapper 105 is previously switched so that a front half stub can be fed toward the collection path 60. After having been cut off, the front half stub is collected into the collection cassette 12 by the motor M3. At this moment, the motor M2 is kept stopped to hold the rear half stub by the rollers 103. After the front half stub has been collected, the switchable flapper 105 is switched to the position as shown and then the motor M2 is driven to feed the rear half stub to the discharge slot 3 via the carry-out path 50.

Even in the desk-top gate apparatus, it is of course possible to use the switchable carry path 30 as shown in FIG. 4 in stead of the switchable flapper 105.

What is claimed is:

1. A checkin gate apparatus comprising:

(a) carrying-in means for carrying in a ticket inserted into an insertion slot;

(b) reading means disposed in the course of a carry path of said carrying-in means, for reading information recorded on an inserted ticket;

(c) ticket cutting means for cutting off the ticket into two stubs after said reading means has read recorded information;

(d) distributing means for respectively distributing the two cut-off ticket stubs into a collection direction and a discharge direction;

(e) collecting means for collecting one of the cut-off stubs of the ticket; and (f) carrying-out means for carrying-out the other of the cut-off stubs of the ticket to a discharge slot to discharge it;

said distributing means comprising a switchable carry path disposed on a discharge slot side of said reading means, for respectively feeding one cut-off half stub to a carry path of said collecting means and the other cut-off half stub to a carry path of said carrying-out means.

2. The checkin gate apparatus of claim 1, which further comprises a portable casing for housing said carrying-in means, said reading means, said ticket cutting means, said distributing means, said collecting means, and said carrying-out means.

3. The checkin gate apparatus of claim 2, wherein said casing is of wagon-type provided with casters for moving said casing.

4. The checkin gate apparatus of claim 2, wherein said casing is provided with a handle for moving said casing.

5. The checkin gate apparatus of claim 1, wherein said ticket cutting means is disposed between said switchable carry path and one of the carry path of said collecting means and the carry path of said carrying-out means.

6. The checkin gate apparatus of claim 1, which further comprises:

(a) checking means for checking information read from a ticket by said reading means; and (b) displaying means for displaying an abnormality when the ticket is determined to be abnormal by said checking means.

7. The checkin gate apparatus of claim 1, which further comprises totalizing means for totalizing any desired items on the basis of information read from the ticket by said reading means.

8. The checkin gate apparatus of claim 7, which further comprises transmitting means for transmitting totalized results of said totalizing means to a central apparatus.

9. The checkin gate apparatus of claim 1, which further comprises receiving means for receiving data transmitted from a central apparatus.

10. The checkin gate apparatus of claim 1, which further comprises communicating means for communicating with a central apparatus, said communicating means comprising a removable connector for connecting or disconnecting a transmission line between said apparatus and the central apparatus.

11. The checkin gate apparatus of claim 1, wherein the same information is recorded on two half portions of a ticket, respectively on both sides of a cut-off line of the ticket.

* * * * *